US005259560A

United States Patent [19]

Dyer

[11] Patent Number: 5,259,560

[45] Date of Patent: Nov. 9, 1993

[54] APPARATUS FOR CLEANING FIBROUS MATS

[76] Inventor: Bill W. Dyer, 2768 County Road 1422, Cullman, Ala. 35055

[21] Appl. No.: 854,545

[22] Filed: Mar. 16, 1992

[51] Int. Cl.[5] ..... B02C 23/40

[52] U.S. Cl. ..... 241/42; 241/159; 241/235; 15/40; 134/122 R

[58] Field of Search ..... 15/40, 88, 883; 68/205 R; 134/122 R; 241/42, 159, 235

[56] References Cited

U.S. PATENT DOCUMENTS

| | | | |
|---|---|---|---|
| 2,925,226 | 2/1960 | Pratique | 241/159 X |
| 3,304,566 | 2/1967 | Doerschlag | 15/40 X |
| 3,333,291 | 8/1967 | Hondzinski | 15/40 X |
| 3,406,624 | 10/1968 | Kutchera et al. | 241/235 X |
| 3,955,528 | 5/1976 | Bounds et al. | 68/205 R |
| 5,013,367 | 5/1991 | Butts | 15/40 |

*Primary Examiner*—Mark Rosenbaum
*Assistant Examiner*—Frances Chin
*Attorney, Agent, or Firm*—Veal & Associates

[57] ABSTRACT

Apparatus for cleaning chicken droppings from one or more mats used as nesting material in chicken nests in a chicken house. The invention includes a housing having a plurality of rollers therein for conveying a mat and pulverizing the chicken droppings adhering thereto. The rollers are paired with each pair including a fluted roller having a plurality of axially extending ridges thereon and a cylindrical roller defining a plurality of radial grooves thereon which cooperate with the ridges to pulverize the chicken droppings. Sprayers are provided to dislodge the pulverized chicken droppings from the mat. A plurality of guide plates are provided to guide the mat through the enclosure and support the mat during spraying.

13 Claims, 2 Drawing Sheets

APPARATUS FOR CLEANING FIBROUS MATS

FIELD OF THE INVENTION

The present invention relates to apparatus for cleaning. In greater particularity, the present invention relates to apparatus for cleaning tuffed mats. In even greater particularity the present invention relates to apparatus for automatically cleaning tuffed mats used as nesting material in chicken nests in a chicken house and having chicken droppings adhering thereto.

BACKGROUND OF THE INVENTION

Tuffed mats are commonly used as nesting material in chicken nests in chicken houses because they may be removed in sections, cleaned and returned to the chicken house without great disturbance to the chicken population. The mats are usually constructed of woven fibrous materials; the most common mats being constructed from what is commonly known as artificial turf which is a mat predominantly woven from plastic fibers. Another common material is a plastic wool comprised of plastic fibers intertwined in no particular configuration or pattern but compressed to form a substantially planar mat. Both artificial turf and plastic wool mats are relatively inexpensive and readily available. The artificial turf and plastic wool, hereinafter mats, are very porous and accordingly provide a large adhering surface for liquids and other low viscosity substances applied thereto. In a chicken house, such other low viscosity substances include chicken droppings which are voluminously applied to the mats by the chicken populace. The droppings seep within the fibrous network of the mat and dry, thus adhering to the fiber and forming a cementitious block or mass. The chicken droppings are very difficult to remove from the mats by conventional washing techniques such as scrubbing or spraying as water sprayed on the mats will only contact the outer surface of the layer of chicken droppings adhering to the mat. Scrubbing with brushes also only effects the outer surface of the layer of chicken droppings. What is needed, and provided by the present invention, is an apparatus that will dislodge and disrupt the mass of the chicken droppings not only from the exterior surface of the mat but from deep within the fibrous mats as well.

SUMMARY OF THE INVENTION

It is the principal object of the present invention to provide an apparatus for cleaning chicken droppings from mats that pulverizes the chicken droppings deep within the woven mat such that the droppings are easier to dislodge from the woven mat.

In support of the principal object, another object of the present invention is to provide an a apparatus for cleaning mats that directs a spray of fluid at high velocity at the mats immediately after the pulverization of the droppings to dislodge the pulverized droppings from the mat.

Another object of the present invention is to support the mats in a vertical plane during high velocity spraying such that the pulverized droppings fall free from the mats when dislodged therefrom by the spraying.

A further object of the present invention is compress the mats to extract the fluids sprayed thereon and any pulverized chicken droppings contained in the fluid from within the woven mats.

These and other objects and advantages of the present invention are accomplished through the use of an enclosure having an input slot defined at a lower end thereof and a discharge portal at an upper end thereof. A mat is inserted within the enclosure through the input slot and intermediate a first pair of rollers rotatably mounted to the enclosure and driven in opposite angular directions by an engine operatively connected to the rollers. One of the first pair of rollers is fluted and the other defines a plurality of radial grooves thereon that cooperate with a plurality of axially extending ridges formed on the fluted roller to pulverize the cementitious mass of chicken droppings as the mat is conveyed intermediate the first pair of rollers. A curved guide plate is provided to guide the mat toward a vertical plane to a second pair of rollers similar to the first pair but spaced closer together. The second pair continues to pulverize the chicken droppings and conveys the mat along the vertical plane intermediate a planar vertical guide plate and a first plurality of sprayers which emit a high velocity spray against the mat which is supported adjacent to the sprayers by the vertical guide plate. The sprayers dislodge a predominate portion of the pulverized chicken droppings from the mat. The mat is conveyed upwardly to a third pair of rollers similar to the first and second pairs but spaced closer together than the second pair. The third pair of rollers continues to pulverize the remaining chicken droppings and conveys the mat through the discharge portal. A second plurality of sprayers are provided to emit a high velocity spray toward one of the third pair of rollers and against the mat to dislodge the remaining pulverized chicken droppings therefrom.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
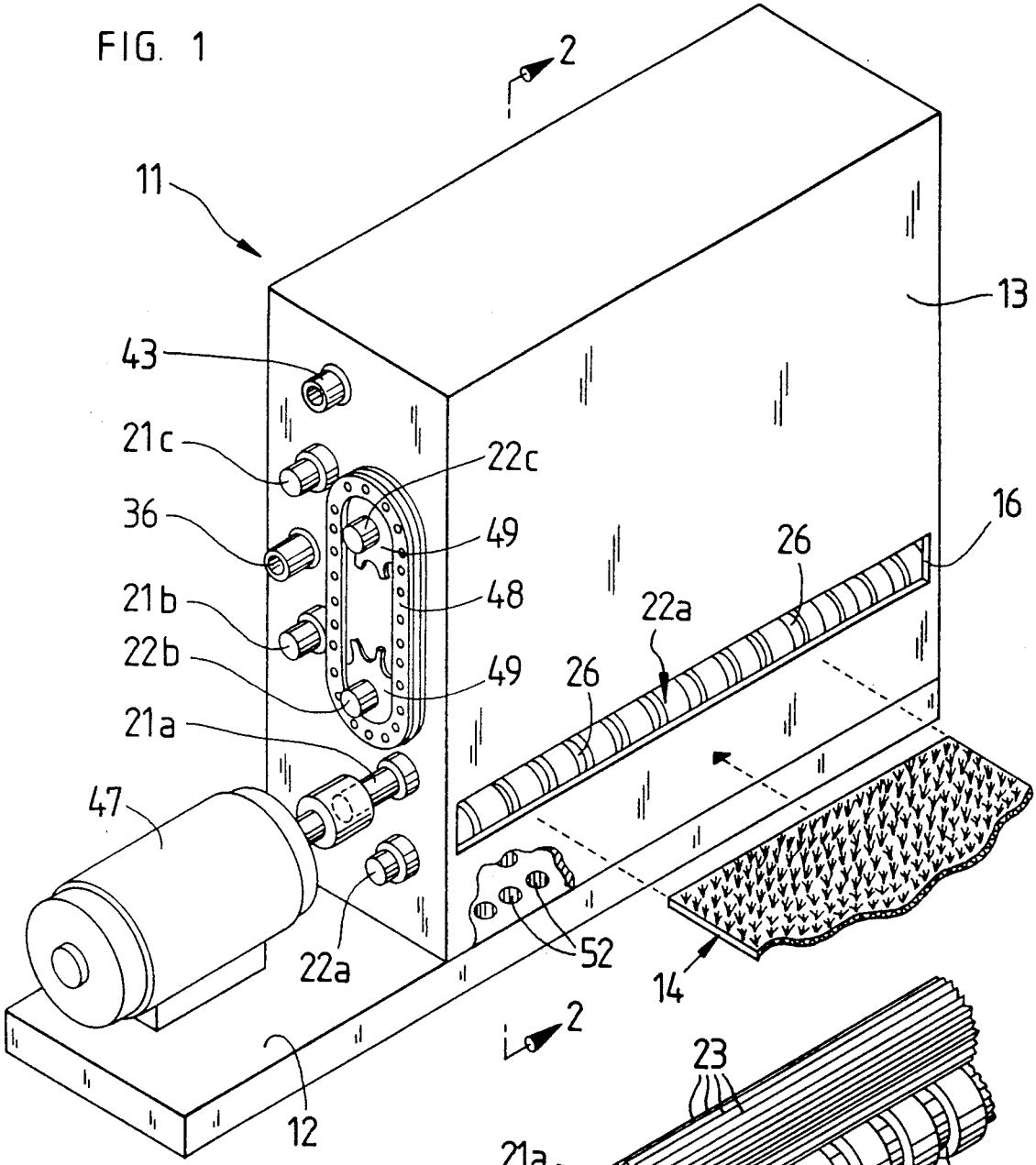
FIG. 1 is a perspective view of the present invention and a mat to be inserted therein.
Figure 3:
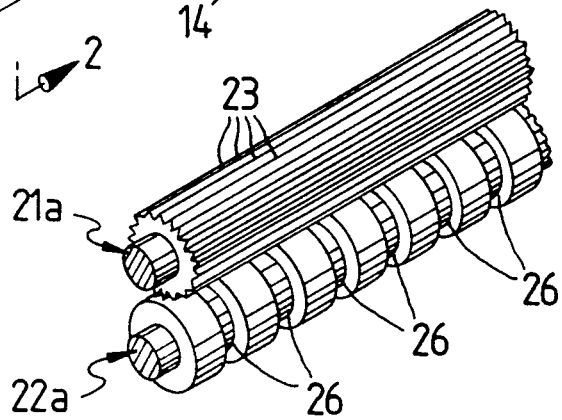
FIG. 3 is a perspective view of a pair of rollers.
Figure 2:
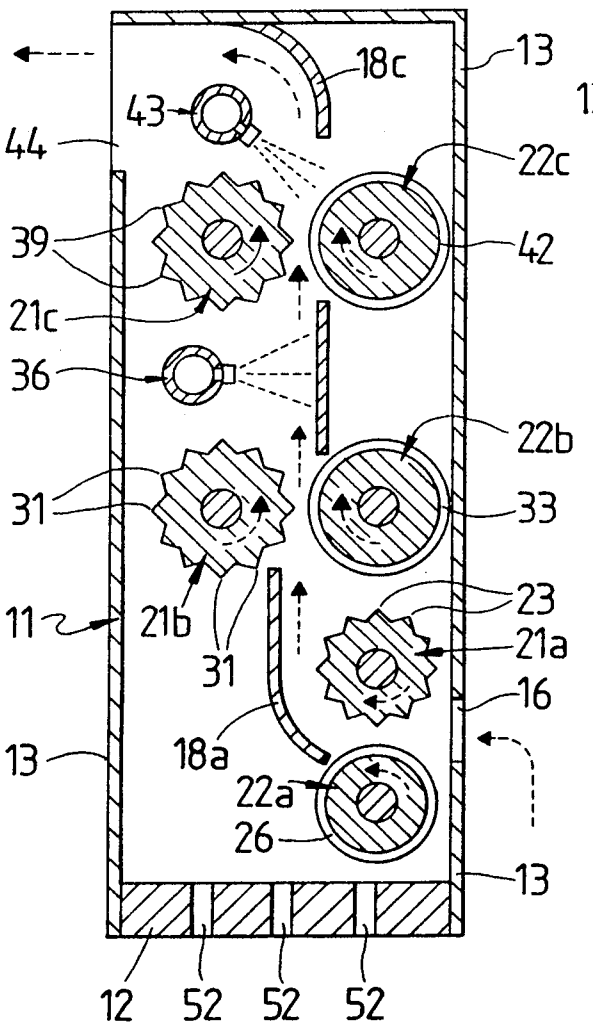
FIG. 2 is a sectional view taken along line 2—2 of FIG.

Referring to the drawings for a clearer understanding of the invention, it should be noted in FIG. 1 that the present invention contemplates the use of a housing 11 including a base 12 and an enclosure 13 connected to the base 12 and supported thereby. One or more woven fibrous mats 14 are inserted within the enclosure 13 through an input slot 16 defined by the enclosure 13. As is shown in FIG. 2, a plurality of driven rollers **21*a*–21*c* and 22*a* are rotatably connected to the enclosure 13 for conveying the mats 14 therethrough. The rollers work in cooperation with a plurality of guide plates 18*a*–18*c* which guide the mats 14 through the enclosure 13. The rollers and guide plates also cooperate to support the mats 14 in spaced relation to a plurality of sprayers which emit a high velocity spray against the mats to dislodge chicken droppings (not shown) therefrom. The rollers include a first pair of rollers connected to the enclosure 13 for rotary movement about parallel horizontal axes in opposite angular directions. A mat 14, inserted within the enclosure 13 through the first pair of rollers and conveyed thereby within the enclosure 13. As shown in FIGS. 2 and 3 the first pair of rollers include a fluted roller 21***a* having a plurality of axially extending ridges 23 thereon for gripping the mats 14 to convey the mats within the enclosure 13. The fluted roller 21*a* compresses the mat 14 against a cylindrical roller 22*a* which cooperates to convey the mat 14 within the enclosure 13. The cylindrical roller 22*a* defines a plurality of radial grooves 26 thereon that cooperate with the ridges 23 to knead the mat 14 and thereby pulverize the chicken droppings adhering thereto. A portion of the droppings will be dislodged from the mats 14 by the kneading of the first pair of rollers. The sprayers will be in operation when the mat 14 is being conveyed and, though the sprayers are not directed at the mat 14 at this time, a quantity of the fluid emitted by the sprayers will fall on and be absorbed by the mat 14. The fluid will soften the chicken droppings thus assisting in the dislodgement thereof from the mat 14. When the mat 14 is conveyed by the first pair of rollers, the rollers compress the mat to partially extract the fluid and to pulverize chicken droppings contained therein. The plurality of guide plates include an arcuate first guide plate 18*a* connected to the enclosure 13 and adjacent to the first pair of rollers 21*a* and 22*a*. The first guide plate 18*a* curves upwardly such that a mat 14 conveyed by the first pair of rollers will move upwardly along the first guide plate 18*a* and into a vertical plane. A second pair of driven rollers are rotatably mounted to the enclosure 13 adjacent and above the first guide plate 18*a* for rotary movement about parallel horizontal axes in opposite angular directions. A mat 14 conveyed along the first guide plate by the first pair of rollers will be received intermediate the second pair of rollers which will engage and convey the mat 14 upwardly in a substantially vertical plane. The second pair of rollers include a fluted roller 21*b* having a plurality of axially extending ridges 31 formed thereon and a cylindrical roller 22*b* defining a plurality of radial grooves 33 thereon. The second pair of rollers are similar to the first pair of rollers 21 except that the second pair are displaced horizontally where the first pair are displaced vertically. Further the first pair are displaced a greater distance than the second pair. The ridges 31 and grooves 33 knead the mat 14 to pulverize the chicken droppings, while the rollers 21*b* and 22*b* compress the mat to extract the fluid and chicken droppings contained therein from the mat 14 and provide further pulverization. A planar second guide plate 18*b* is connected to the enclosure 13 and adjacent to the second pair of rollers. The second guide plate 18*b* extends upwardly from the second pair of rollers in parallel planar relation to the vertical plane. The mat 14 is urged upwardly by the second pair of rollers and along the second guide plate 18*b*. The plurality of sprayers include one or more primary sprayers 36 connected to the enclosure 13 in spaced relation to the second guide plate 18*b*. The primary sprayers 36 emit a high velocity spray of fluid toward the second guide plate 18*b*. The mat 14 is conveyed intermediate the primary sprayers 36 and the second guide plate 18*b* wherein the fluid discharged from the primary sprayers 36 will dislodge the pulverized chicken droppings from the mat 14. The discharged spray of fluid urges the mat 14 against the second guide plate 18*b* as the mat 14 is conveyed therealong by the second pair of rollers 21*b* and 22*b*. Accordingly, the mat 14 is supported vertically by the second guide plate 18*b* and the spray such that pulverized chicken droppings dislodged by the primary sprayers will be dislodged from the mat 14. A third pair of driven rollers are rotatably connected to the enclosure 13 and adjacent to and above the second guide plate 18*b* for rotary movement in opposite angular directions about parallel horizontal axes. The mat 14, when conveyed along the second guide plate 18*b* by the second pair of rollers 21*b* and 22*b*, is received intermediate the third pair of rollers and conveyed upwardly thereby. The third pair of rollers includes a fluted roller 21*c* having axially intending ridges 39 formed thereon and a cylindrical roller 22*c* defining a plurality of radial grooves 42 therein that cooperate with ridges 39 to knead the mat 14 and pulverize the chicken droppings adhering thereto. The third pair of rollers 21*c* and 22*c* are horizontally displaced; however, the third pair of rollers are displaced a lesser distance than the second pair of rollers 21*b* and 22*b*. The rollers 21*c* and 22*c* compress the mat to further extract the fluid and chicken droppings contained therein from the mat 14. One or more secondary sprayers 43 are connected to the enclosure 13 in spaced relation to the fluted roller 21*c* for spraying fluid toward the guide plate 18*c* and against the mat 14. The arcuate third guide plate 18*c* is connected to the enclosure above said third pair of rollers 21*c* and 22*c* and curves upwardly therefrom toward the discharge slot 44 to guide the mat 14 thereto and from the enclosure.

Figure 5:
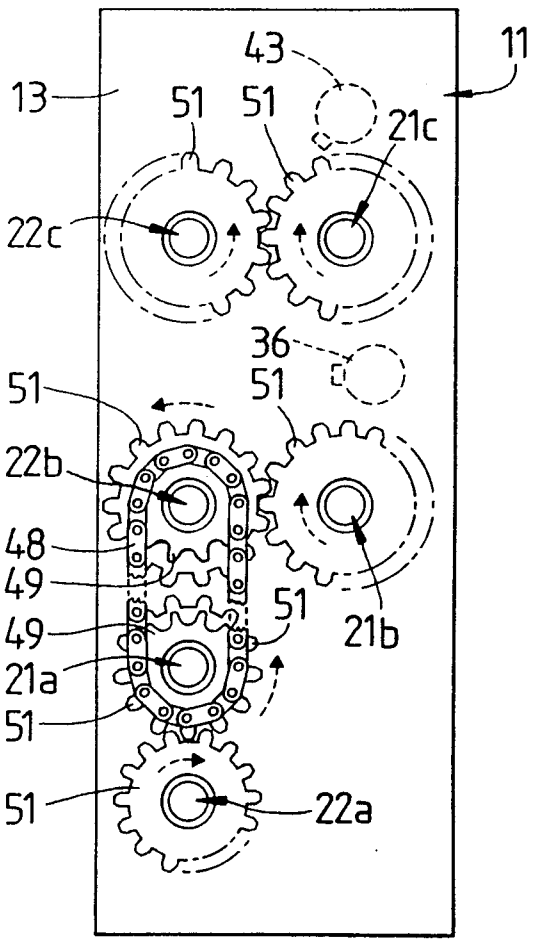
FIG. 5 is a side elevational view opposite that shown in FIG. 4.
Figure 4:
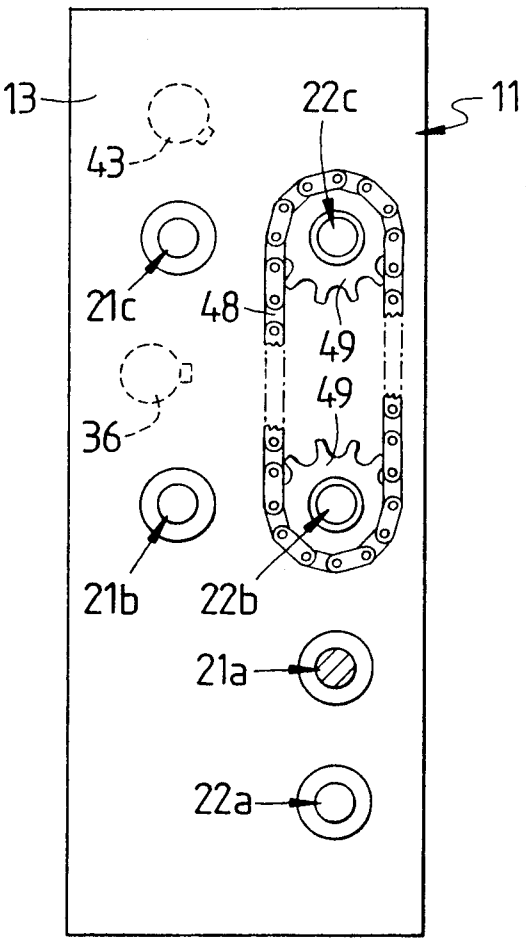
FIG. 4 is a side elevational view of the present invention.

As shown in FIG. 1, a motor 47 is connected to and supported by the frame 11 and operatively connected to the fluted roller 21*a* to drive the fluted roller in a predetermined angular direction. As shown in FIGS. 5 and 6, chains 48, sprockets 49 and gears 51 are connected to selected ends of the rollers to link the rollers for concomitant rotary movement, such that rotation of the fluted roller 21*a* by motor 47 will resultantly facilitate the rotary movement of the other rollers in selected angular directions. Drainage holes 52 are provided through the enclosure to permit the fluid and chicken droppings to pass therefrom. From the foregoing, it should be clear that the present apparatus represents a substantial improvement over the prior art, however by way of example it should be noted that a mat may be thoroughly cleaned by this apparatus in much less than a minute, whereas the same mat would require substantial physical effort and time in excess of ten to fifteen minutes to clean manually.

While I have shown my invention in one form, it will be obvious to those skilled in the art that it is not so limited but is susceptible of various changes and modifications without departing from the spirit thereof.

What I claim is:

1. Apparatus for cleaning chicken droppings from a fibrous mat used as nesting material in chicken nests in a chicken house, comprising:

(a) an enclosure defining an input portal and a discharge portal;

(b) a plurality of driven parallel fluted rollers rotatably mounted to said enclosure having a plurality of axially extending ridges thereon for gripping said mat and pulverizing said chicken droppings thereon;

(c) a plurality of driven cylindrical rollers, each rotatably mounted to said enclosure in proximal parallel relation to one of said plurality of fluted rollers and having a plurality of radial grooves thereon, wherein said mat is conveyed by and intermediate said plurality of fluted rollers and said cylindrical rollers which cooperatively knead said fibrous mat to pulverize said chicken droppings adhering thereto and dislodge said chicken droppings therefrom.

2. Apparatus as defined in claim 1 further comprising a plurality of sprayers connected to said enclosure proximal to said plurality of fluted and cylindrical rollers for discharging a quantity of fluid against said fibrous mat at a velocity sufficient to dislodge said pulverized chicken droppings therefrom.

3. Apparatus for cleaning chicken droppings from a fibrous mat used as nesting material in chicken nests in a chicken house, comprising:

(a) a plurality of paired parallel rollers, rotatably connected to a frame, for pulverizing a mass of said chicken droppings adhering to and solidifying within said fibrous mat through opposing rotary movement about one of a plurality of parallel horizontal axis wherein each said pair of rollers comprises a fluted roller having a plurality of axially extending ridges thereon and a cylindrical roller having a plurality of radial grooves thereon wherein said fibrous mat is received intermediate said fluted and cylindrical rollers such that said ridges and grooves compressively cooperate to pulverize said chicken droppings and convey said fibrous mat from one said pair of rollers to another, said plurality of paired parallel rollers comprising a first pair of rollers spaced a first predetermined distance apart, a second pair of rollers spaced a second predetermined distance apart that is less than said first predetermined distance, and a third pair of rollers spaced a third predetermined distance apart that is less than said second predetermined distance, such that each successive pair of rollers exerts a greater compressive force on said fibrous mat than a preceding pair; and (b) spraying means supported adjacent to said rollers for discharging high velocity water against said fibrous mat at a velocity sufficient to dislodge said pulverized chicken droppings therefrom which have seeped into and solidified within the fibrous network of said fibrous mat.

4. Apparatus as defined in claim 3 further comprising guide means for guiding said fibrous mat along said plurality of paired rollers and for supporting said mat adjacent to said spraying means.

5. Apparatus as defined in claim 3 further comprising means connected to said frame and said plurality of paired rollers for driving said plurality of paired rollers about said plurality of horizontal axis, wherein each said fluted roller is rotated in an opposite angular direction to said cylindrical roller associated therewith.

6. Apparatus as defined in claim 5 wherein said driving means comprises:

(a) a motor operatively connected to one of said plurality of paired rollers for rotating said one in a selected angular direction; and (b) linkage means operatively interconnecting said plurality of paired rollers for concomitant rotation with said one.

7. An apparatus for cleaning a mass of solidified chicken droppings from a mat used as nesting material in chicken nests in a chicken house, comprising:

(a) an enclosure having a plurality of sprayers therein for spraying high velocity water onto said mat at a velocity sufficient to dislodge pulverized chicken droppings which solidified on said mat from said mat;

(b) roller means for conveying said mat through said enclosure and concomitantly crushing accumulated chicken droppings adhering to said mat wherein said roller means comprises a first pair of driven rollers in spaced relation rotatably connected to said enclosure for rotary movement about parallel horizontal axes in opposite angular directions such that said mat when inserted intermediate said first pair of driven rollers is conveyed thereby within said enclosure, said first pair of driven rollers comprising a fluted roller having a plurality of axially extending ridges formed thereon for gripping said mat and pulverizing said chicken droppings thereon and a cylindrical roller defining a plurality of radial grooves thereon for pulverizing said chicken droppings, such that said mat, when inserted intermediate said first pair of rollers, is engaged by said fluted roller and pressed against said cylindrical roller to pulverize said chicken droppings; and (c) a plurality of guide plates for guiding said mat through said enclosure and adjacent to said plurality of sprayers, wherein said roller means and said plurality of guide plates support said mat in spaced relation to said plurality of sprayers such that water discharged from said sprayers at high velocity will impact said mat to soften and dislodge said pulverized chicken droppings therefrom.

8. Apparatus as defined in claim 1 wherein said plurality of guide plates comprises a curved first guide plate connected to said enclosure adjacent to said first pair of rollers and curving upwardly therefrom, such that said mat, when conveyed by said first pair of rollers, is urged upwardly along said first guide plate and into a vertical plane.

9. Apparatus as defined in claim 8 wherein said roller means comprises a second pair of driven rollers rotatably connected to said enclosure adjacent to and above said curved first guide plate for rotary movement about parallel horizontal axes in opposite angular direction, such that said mat, when urged along said first guide plate, is received intermediate said second pair of driven rollers and is conveyed thereby upwardly along said vertical plane, said second pair of driven rollers displaced a lesser distance in spaced relation than said first pair of driven rollers thus exerting a greater compressive force on said mat than said first pair of driven rollers wherein said second pair of rollers comprises:

(a) a fluted roller having a plurality of axially extending ridges formed thereon for engaging said mat and pulverizing said chicken droppings thereon; and (b) a cylindrical roller defining a plurality of radial grooves thereon for pulverizing said chicken droppings, such that said mat, when conveyed intermediate said second pair of rollers by said first pair of rollers, is gripped by said fluted roller and pressed against said cylindrical roller to pulverize said chicken droppings and extract said fluid and said pulverized chicken droppings contained thereon from said mat.

10. Apparatus as defined in claim 9 wherein said plurality of guide plates comprises a planar second guide plate connected to said enclosure and adjacent to said second pair of rollers and extending upwardly therefrom in parallel planar relation to said vertical plane, such that said mat is urged upwardly along said second guide plate by said second pair of rollers.

11. Apparatus as defined in claim 10 wherein said sprayers comprise at least one first sprayers connected to said enclosure in spaced relation to said second guide plate for emitting a high velocity of spray fluid toward said second guide plate, such that said mat is conveyed intermediate said second guide plate and said first sprayers, wherein said high velocity fluid discharged from said first sprayers forces said mat against said second guide plate dislodging said pulverized chicken droppings from said mat.

12. Apparatus as defined in claim 10 wherein said roller means comprises a third pair of driven rollers rotatably connected to said enclosure and adjacent to and above said second guide plate for rotary movement in opposite angular directions about parallel horizontal axes, such that said mat, when conveyed along said second guide plate, is received intermediate said third pair of rollers and conveyed upwardly thereby, said third pair of driven rollers displaced a lesser distance in spaced relation than said second pair of driven rollers thus exerting a greater compressive force on said mat than said second pair of driven rollers wherein said third pair of rollers comprises:

(a) a fluted roller having a plurality of axially extending ridges formed thereon for gripping said mat and pulverizing said chicken droppings adhering thereto; and (b) a cylindrical roller defining a plurality of radial grooves for pulverizing said chicken droppings, such that said mat, when conveyed intermediate said third pair of rollers by second pair of rollers, is gripped by said fluted roller and pressed against said cylindrical roller to pulverize said chicken droppings and extract said fluid and said pulverized chicken droppings contained thereon from said mat.

13. Apparatus as defined in claim 12 wherein said plurality of guide plates comprises an arcuate third guide plate connected to said enclosure above said third pair of rollers and curving upwardly therefrom for guiding said mat toward a discharge portal defined by said enclosure.

* * * * *